US006232732B1

(12) United States Patent
Haasen et al.

(10) Patent No.: US 6,232,732 B1
(45) Date of Patent: May 15, 2001

(54) METHOD AND CIRCUIT FOR BRAKING AN ELECTRIC DRIVE MOTOR

(75) Inventors: Rolf Haasen, Mönchengladbach; Ferdinand-Josef Hermanns, Erkelenz; Hans-Günter Wedershoven, Nettetal, all of (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/373,452

(22) Filed: Aug. 12, 1999

(30) Foreign Application Priority Data

Aug. 13, 1998 (DE) ..... 198 36 701

(51) Int. Cl.[7] ..... H02P 3/12

(52) U.S. Cl. ..... 318/375; 318/376; 318/471; 388/934

(58) Field of Search ..... 318/471, 375, 318/376, 379; 388/934

(56) References Cited

U.S. PATENT DOCUMENTS 4,173,732 * 11/1979 Anderson ..... 318/375
4,581,565 * 4/1986 Van Pelt et al. ..... 318/294
4,696,435 * 9/1987 Hermanns ..... 242/18.1
5,735,473 * 4/1998 Hermanns et al. ..... 242/18.1
5,778,703 * 7/1998 Imai et al. ..... 68/12.02

FOREIGN PATENT DOCUMENTS 2 106 898 8/1972 (DE) .
38 05 662 A1 9/1989 (DE) .
39 11 505 A1 10/1990 (DE) .
41 06 331 A1 9/1991 (DE) .
40 21 663 A1 1/1992 (DE) .
0 773 623 A1 5/1997 (EP) .
09110298A 4/1997 (JP) .

* cited by examiner

*Primary Examiner*—Robert E. Nappi
*Assistant Examiner*—Rita Leykin
(74) *Attorney, Agent, or Firm*—Kennedy Covington Lobdell & Hickman, L.L.P.

(57) ABSTRACT

In a method for braking an electric drive motor, especially a drive motor for driving a grooved drum of a winding head of a bobbin winding machine which motor is loaded for braking in a direction opposite to a rated nominal current with a braking current, the instantaneous thermal load of the drive motor is detected and the strength of the brake current is selected as a function of this thermal load of the drive motor.

8 Claims, 1 Drawing Sheet

METHOD AND CIRCUIT FOR BRAKING AN ELECTRIC DRIVE MOTOR

BACKGROUND OF THE INVENTION

The present invention relates to a method of and circuit for braking an electric drive motor and, more particularly, to a method and circuit for braking a drive motor for driving a grooved drum of a winding head in a bobbin winding machine wherein the motor is braked in a direction opposite to a rated nominal current by loading the motor with a braking current whose strength can be a multiple of the rated current.

In many applications of electric drive motors, attempts are made to brake the motors to a standstill as rapidly as possible. In the case of bobbin winding machines, e.g., in which an electric drive motor drives a grooved drum of a winding head, attempts are made to brake the drive motors as rapidly as possible as required in order to keep the standstill times of the winding heads short and thereby to keep the efficiency of the bobbin winding machine high. Spinning cops are rewound at the winding heads to large-volume cross-wound bobbins. The yarn are monitored during the rewinding for yarn errors. If a yarn error is determined, the rewinding process is interrupted, the yarn piece with the error is cut out, a yarn connection is established between the remaining yarn pieces, and the winding process is restarted. In order to carry this out in as short a time as possible, it is also necessary to bring the grooved drum to a standstill as rapidly as possible.

In order to brake an electric drive motor electrically, it is loaded with a brake current in a direction opposite to the rated current of the motor. The braking time is thereby a function of the magnitude of the braking current, which can be a multiple of the rated current without any concern for damage to the drive motor in the normal instance. Usually, a thermal monitoring device is provided for such drive motors which determines a thermal overload and then interrupts the operation of the drive motor and thereby prevents severe motor damage from occurring as a consequence of overheating of the motor. Such a thermal overloading can occur if a drive motor of a grooved drum is repetitively braked and re-accelerated for short periods of time in succession. The drive motor is then deenergized by the temperature monitoring device and remains deenergized until the temperature has dropped back below the set safety value. As a rule, a red light is also placed at the winding head concerned, which indicates that there is a problem at this winding head which requires an intervention of the operating personnel. This results in standstill times and, in turn, in not insignificant losses of output efficiency of the device or machine involved.

SUMMARY OF THE INVENTION

The present invention thus has the object of creating a braking method and a braking circuit of the initially described type in which an element driven by the drive motor or the associated machine can operate with the greatest efficiency possible.

This object is basically achieved by a braking method and circuit in which the instantaneous thermal load of the drive motor is constantly detected and the strength of the braking current is selected as a function of this thermal load of the drive motor.

Thus, upon each initiation of a braking process, the highest possible strength of the braking current suitable for the braking process is determined so that, even in the case of several braking processes repeated at short intervals in succession, the work can be performed with a maximum braking force which minimizes the braking time without any overloading of the drive motor occurring. Different braking times accordingly result as a function of the instantaneous thermal loading of the drive motor, that is, relatively higher braking times occur upon a relatively higher thermal load without, however, the drive motor entering into a temperature range requiring the motor to be deenergized.

In order to keep the equipment expense as low as possible, one aspect of the invention provides that the instantaneous thermal loading of the drive motor is detected from the loading of the drive motor with current over time. In this manner, the expense for measuring technology or equipment can be kept relatively low.

A further development of the invention provides that graduated values are set for braking currents which are associated with an area of thermal loading. Such a stepped fixing of the suitable braking current is quite sufficient for a practical realization of the invention objectives.

The braking circuit of the invention basically provides means for detecting the instantaneous thermal load of the drive motor and means for selecting the braking current to be applied for a braking process as a function of this thermal load.

According to a further aspect of the invention, the braking circuit provides means for assigning the detected thermal load to values of thermal loads stored in a memory and means for activating a braking current with a strength set for the assigned thermal load value.

Further features and advantages of the invention are explained in the following description of exemplary embodiments of the invention shown in the accompanying drawings.

DESCRIPTION OF THE PREFERRED EMBODIMENT

Figure 1:
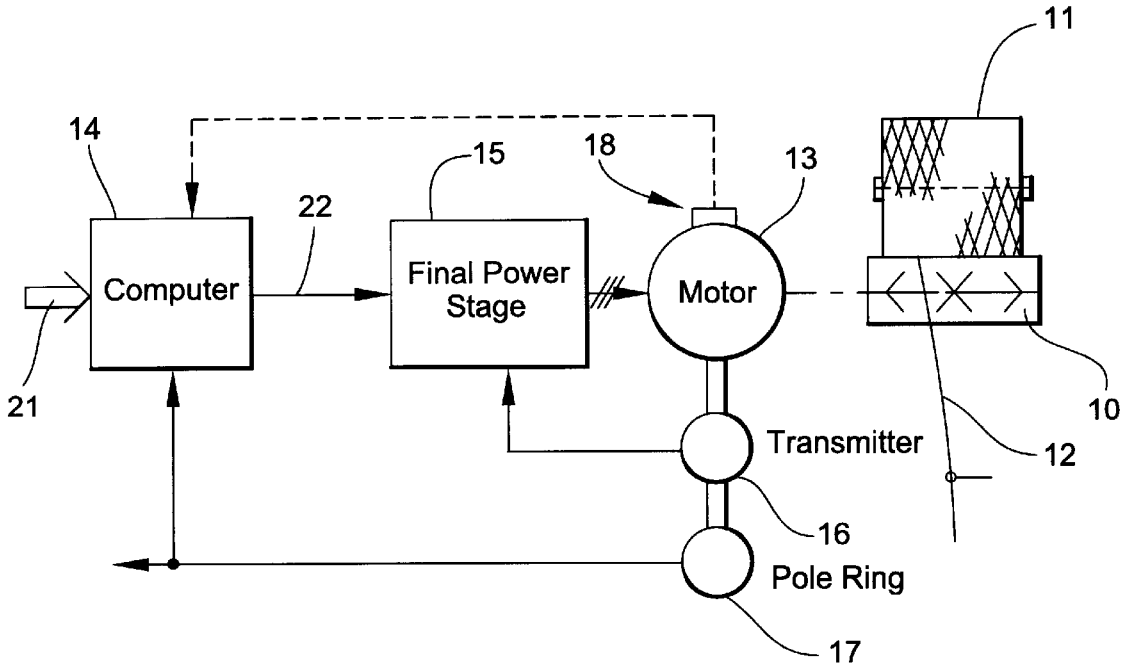
FIG. 1 is a schematic diagram of a first exemplary embodiment of a circuit arrangement in accordance with the present invention containing a braking circuit for a drive motor of grooved drum of a winding head of a bobbin winding machine.

In bobbin winding machines, the individual winding heads are provided with a grooved drum 10 which drives a relatively large-volume take-up bobbin via frictional surface contact therebetween. During the rewinding process, grooved drum 10 places yarn 12 drawn from a spinning cop (not shown) traversing in back and forth directions along the bobbin in such a manner that a conical or cylindrical cross-wound bobbin 11 is wound.

Grooved drum 10 is driven by means of electromotor 13, which is an electronically commutated servomotor in the exemplary embodiment. However, the circuit arrangement with the braking circuit in accordance with the present invention is suitable in principle for every type of electric drive motor.

If a yarn error to be separated out of yarn 12 is determined or if a yarn break occurs the winding process is immediately interrupted. That is, cross-wound bobbin 11 is raised off grooved drum 10 and is braked to a standstill by a bobbin brake which is arranged on the creel but not shown in the drawing. Grooved drum 10, which has a not insignificant weight inertia, is also braked in that the associated drive motor 13 is loaded with braking current directed in a direction opposite to the direction of current of the rated current present during the normal winding operation. In order to obtain the most rapid possible stopping of drive motor 13, a braking current with the highest possible strength is selected, which can be a multiple of the strength of the rated current. The thermal loading which briefly appears thereby is not so strong that it can result in damage to drive motor 13.

If, however, several brakings have to be performed within a short time period the thermal loading of drive motor can become very great. Usually, such drive motors are therefore provided with a thermal overload protection which assures that drive motor 13 deenergizes when a certain safety temperature is reached. A multiple braking of grooved drum 10 within a short time can thus result in the actuation of the thermal overload protection so that drive motor 13 is then deenergized until the temperature has dropped sufficiently far below the safety temperature. As a rule, a red light is additionally placed at the winding head concerned, which indicates to the operating personnel that a machine error is present. This standstill results in downtimes, e.g., in the exemplary embodiment of a winding head, which results in a loss of efficiency of the winding head concerned and therewith of the bobbin winding machine.

In order to avoid these standstill times caused by thermal overloading during braking, the present invention provides that the instantaneous thermal loading of drive motor 13 is continuously detected and that the strength of the brake current for an ensuing braking process is selected as a function thereof such that it is assured that no thermal overloading occurs. In this manner, the shortest theoretically possible braking time is not used for braking in every braking process; however, the braking takes place with the technically reliably shortest braking time which avoids a thermal overloading of drive motor 13.

In the exemplary embodiment according to FIG. 1, winding-head computer 14 sets the current strength and current direction with which drive motor 13 is loaded. Winding-head computer 14 thus determines on the one hand the speed of drive motor 13 and on the other hand its braking behavior as a function of the thermal load state of drive motor 13. Winding-head computer 14 processes information of a central computer (not shown) which is supplied to it, e.g., via machine bus 21. This information can concern, e.g., the winding speed or the speed of drive motor 13 and optionally also data relating to the prevention of ribboning in order to avoid ribbon windings on cross-wound bobbin 11. The signals of winding-head computer 14, which pass over line 22 to final power stage 15, are appropriately processed by final power stage 15 which retransmits the current in the proper phase to the windings of drive motor 13. To this end, final stage 15 also processes information of rotorposition transmitter 16.

The actual speed or actual revolutions per minute of drive motor 13 detected on pole ring 17 of drive motor 13 are signaled back to winding-head computer 14 for speed control.

The actual detected speed of drive motor 13 can also be utilized for further operations at the winding head. It can be conducted, e.g., to a cleaner which sets the measuring intervals for the monitoring of yarn 12 as a function of the actual speed.

Winding-head computer 14 also processes information about the instantaneous thermal loading of drive motor 13. As is indicated in FIG. 1, thermal sensor 18 is assigned for this purpose to drive motor 13 whose signal is fed into winding-head computer 14.

Figure 2:
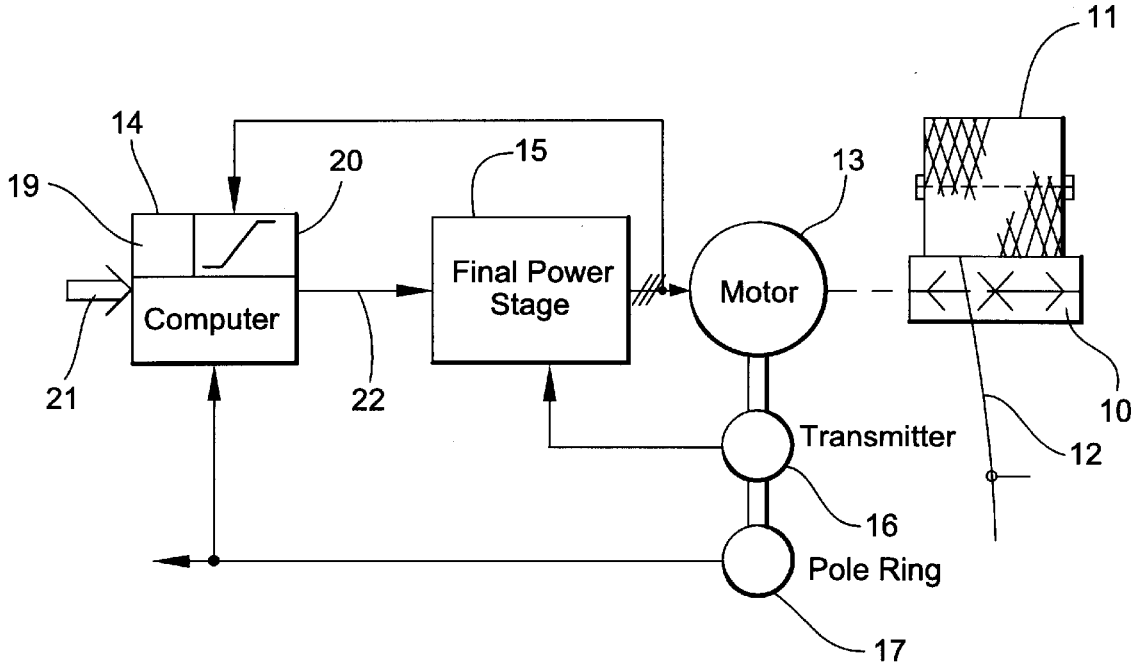
FIG. 2 is another schematic diagram of a further exemplary embodiment of a braking circuit in accordance with the present invention.

However, winding-head computer 14 can also be arranged to calculate the instantaneous thermal loading of drive motor 13, as indicated in FIG. 2, by detecting the current load of drive motor 13 over time. Winding-head computer 14 has in this instance integrator 20 as well as memory 19. A plurality of drum load value ranges with their associated braking values are thereby deposited in memory 19. Using this data, winding-head computer 14 then sets the strength of the brake current with which drive motor 13 can be maximally loaded for each braking process such that the shortest possible braking time is achieved without resulting in an inadmissible thermal overloading of drive motor 13.

Limited ranges for the instantaneous thermal load of drive motor 13 as well as the associated, still admissible maximum strengths of the brake currents are deposited in a purposeful manner in memory 19 of winding-head computer 14. Thus, before a braking process is initiated winding-head computer 14 can inquire in a simple manner in which range the instantaneous thermal load is and then set the brake current with a suitable strength.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A method for braking an electric drive motor, the motor normally being driven by a current flowing in a first direction, the method comprising the steps of:

detecting the instantaneous thermal load of the drive motor;

determining the magnitude of a braking current to be applied to the motor, the magnitude being determined as a function of the detected thermal load; and applying the braking current to the motor to slow the motor, the braking current flowing in a direction opposite to the first direction.

2. The method of claim 1, characterized in that the drive motor is arranged for driving a grooved drum of a winding head of a bobbin winding machine.

3. The method according to claim 1, characterized in that the detecting of the instantaneous thermal load of the drive motor includes detecting the current load of the drive motor over time.

4. The method according to claim 1, characterized by storing graduated values for brake currents, each graduated value being assigned to a range of thermal loads.

5. A braking circuit for an electric drive motor, the motor normally being driven by a current flowing in a first direction, the circuit comprising:

means for applying a braking current to the drive motor in a direction opposite to the first direction;

means for detecting the instantaneous thermal load of the drive motor; and means for selecting the magnitude of the braking current for each braking application as a function of the detected thermal load.

6. The braking circuit according to claim 5, characterized in that the drive motor is arranged for driving a grooved drum of a winding head of a bobbin winding machine.

7. A braking circuit for an electric drive motor normally driven via a rated nominal current, comprising means for applying a braking current to the drive motor in a direction opposite to the rated nominal current, including a braking current of a strength which is a multiple of the rated current, means for detecting the instantaneous thermal load of the drive motor, and means for selecting the braking current for each braking application as a function of the detected thermal load, wherein the means for selecting the braking current includes means for assigning the detected instantaneous thermal load to values of thermal loads stored in a memory and means for determining a brake current with a predetermined strength set for each assigned value.

8. A braking circuit for an electric drive motor normally driven via a rated nominal current, the motor being arranged for driving a grooved drum of a winding head of a bobbin winding machine, wherein the braking circuit comprises means for applying a braking current to the drive motor in a direction opposite to the rated nominal current, including a braking current of a strength which is a multiple of the rated current, means for detecting the instantaneous thermal load of the drive motor, and means for selecting the braking current for each braking application as a function of the detected thermal load, wherein the values of thermal loads are stored in the form of graduated ranges in a memory and a strength of the braking current is predetermined for each range.

* * * * *